US006218070B1

(12) United States Patent
Rüger

(10) Patent No.: US 6,218,070 B1
(45) **Date of Patent: *Apr. 17, 2001**

(54) PROCESS TO MAKE ULTRAHIGH CONTRAST IMAGES

(75) Inventor: Reinhold Rüger, Rödermark (DE)

(73) Assignee: Agfa-Gevaert, N.V., Mortsel (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/209,174

(22) Filed: Mar. 10, 1994

(30) Foreign Application Priority Data

Mar. 30, 1993 (DE) ..... 43 10 327

(51) Int. Cl.[7] ..... G03C 5/29
(52) U.S. Cl. ..... 430/264; 430/265; 430/486
(58) Field of Search ..... 430/264, 265, 430/267, 268, 438, 440, 446, 481, 483, 484, 486, 487, 566

(56) References Cited

U.S. PATENT DOCUMENTS

| | | | | |
|---|---|---|---|---|
| 2,648,604 | | 8/1953 | Welliver et al. | 430/446 |
| 3,532,499 | | 10/1970 | Willems et al. | 430/266 |
| 3,632,345 | * | 1/1972 | Marx | 430/566 |
| 4,135,931 | | 1/1979 | Yoneyama et al. | 430/267 |
| 4,168,977 | | 9/1979 | Takada et al. | 430/446 |
| 4,224,401 | | 9/1980 | Takada et al. | 430/437 |
| 4,853,321 | * | 8/1989 | Momoki et al. | 430/446 |
| 4,937,160 | | 6/1990 | Rüger | 430/264 |
| 4,965,169 | * | 10/1990 | Hirano et al. | 430/265 |
| 5,013,844 | | 5/1991 | Rüger | 546/332 |
| 5,130,480 | | 7/1992 | Rüger | 564/151 |
| 5,153,111 | * | 10/1992 | Yoshida et al. | 430/486 |
| 5,190,847 | | 3/1993 | Chan et al. | 430/264 |
| 5,236,807 | * | 8/1993 | Inoue et al. | 430/264 |
| 5,279,919 | * | 1/1994 | Okamura et al. | 430/264 |
| 5,284,733 | * | 2/1994 | Kojima et al. | 430/265 |
| 5,288,590 | * | 2/1994 | Kuwabara et al. | 430/264 |
| 5,316,889 | * | 5/1994 | Sakai | 430/264 |
| 5,316,890 | * | 5/1994 | Okamura et al. | 430/264 |
| 5,340,694 | * | 8/1994 | Hioki et al. | 430/264 |
| 5,372,911 | * | 12/1994 | Obi et al. | 430/264 |
| 5,378,578 | * | 1/1995 | Hoshimiya et al. | 430/264 |

FOREIGN PATENT DOCUMENTS

| | | |
|---|---|---|
| 27 25 043 | 6/1980 | (DE) . |
| 0 032 456 | 7/1981 | (EP) . |
| 0 034 038 | 8/1981 | (EP) . |
| 0 126 000 | 11/1984 | (EP) . |
| 0 138 200 | 4/1985 | (EP) . |
| 0 203 521 | 12/1986 | (EP) . |
| 0 217 310 | 4/1987 | (EP) . |
| 0 253 665 | 1/1988 | (EP) . |
| 0 254 195 | 1/1988 | (EP) . |
| 0 324 391 | 7/1989 | (EP) . |
| 0 324 426 | 7/1989 | (EP) . |
| 0 326 443 | 8/1989 | (EP) . |
| 0 356 898 | 3/1990 | (EP) . |
| 0 473 342 | 3/1992 | (EP) . |
| 0 501 546 | 9/1992 | (EP) . |

OTHER PUBLICATIONS

Robt. W. Kulpinski, Photothermographic Film Processor, *Research Disclosure 17843*.
Development Nucleation by Hydrazine and Hydrazine Derivatives, *Research Disclosure* 23510.
Carpenter et al., Photographic Silver Halide Emulsions, Preparations, Addenda Processing and Systems, *Research Disclosure 17643*, Eastman Kodak, Rochester, NY.
Mason, *Photographic Processing Chemistry*, London/New York, 1966, PG 41 FF.

* cited by examiner

*Primary Examiner*—Hoa Van Le
(74) *Attorney, Agent, or Firm*—Breiner & Breiner

(57) ABSTRACT

A process to make ultrahigh contrast photographic negative images is disclosed. In known processes, particularly those using hydrazine compounds, developer solutions to increase contrast contain high concentrations of amino compounds that are volatile, have an annoying, unwholesome odor, and corrode the development machines. If development is conducted in the presence of onium compounds having both quaternary nitrogen and tertiary amine functions in the molecule, the process can operate with odor-free developers that do not release corrosive vapors. The invention can be used in reprography for steps preliminary to printing.

10 Claims, No Drawings

PROCESS TO MAKE ULTRAHIGH CONTRAST IMAGES

BACKGROUND OF THE INVENTION

1. Field of the Invention

The invention involves a process to make ultrahigh contrast negative images by using photosensitive recording materials with silver halide emulsions, and a means for performing the process.

2. Description of the Related Art

In reprography, continuous tone images must frequently be converted to halftone images. Silver halide materials are used for this purpose and are developed by special processes to an ultrahigh contrast, that is, to a maximum slope in the density curve of more than 10. Known examples are lithographic processes with low sulfite hydroquinone developers containing formaldehyde, developing with hydroquinone and a superadditive auxiliary developer in the presence of hydrazine compounds, or developing at relatively high pH in the presence of development inhibitors, such as tetrazole compounds.

Certain amino compounds are often used in these processes to further increase contrast. EP-00 32 456-B1 claims a method for processing a recording material, in the presence of a hydrazine compound, with a hydroquinone/3-pyrazolidinone developer containing an amino compound in a quantity to increase contrast.

EP-04 73 342-A1 describes a photographic silver halide material that can be developed to ultrahigh contrast in a developer with a pH<11. The photosensitive layer of this material contains a certain hydrazine compound and an amino or quaternary onium compound and is adjusted to a pH of at least 5.9.

Cationic surfactants and dyes with quaternary ammonium groups have long been known as development accelerators (L. F. A. Mason, "Photographic Processing Chemistry", London and New York, 1966, page 41 ff). U.S. Pat. No. 4,135,931 describes the use of certain pyridinium compounds to accelerate lithographic development. However, contrast is not increased in these known uses.

Developers containing an amino compound to increase contrast have disadvantages. The required concentration of the amino compound is considerable and is often close to the solubility limit. The solubility limit can be easily exceeded as a result of a temperature increase or slight concentration changes from water evaporation during use, and the amino compound is liberated. This results in irregular development and contaminates the recording material and the developing machine. Because of their vapor volatility, the liberated amino compounds also reach other parts of the development machine and cause unwanted contamination and corrosion.

A very unpleasant odor occurs in the use of developers containing known amino compounds, due to the high required concentration and volatility of these compounds.

Because the amino compounds have limited solubility, it is difficult to formulate the usual commercial developer concentrates. EP-A-02 03 521 discloses that salts of certain sulfonic acids and carboxylic acids can be used as solubilizing agents. However, the other problems cited are not solved by such additives.

Known developers usually have a pH above 11. Therefore, they are not adequately stable in use, and they corrode parts of the development machine.

SUMMARY OF THE INVENTION

The problem involved in the invention is to make ultrahigh contrast negative images by a rapid process with a stable, odorless, and non-corrosive developer.

This problem is solved by a process to make ultrahigh contrast photographic negative images by developing, in the presence of an onium compound, a photosensitive recording material having at least one layer with a silver halide emulsion, characterized in that the molecule of the onium compound has at least one quaternary nitrogen atom and at least one tertiary amine function.

DESCRIPTION OF THE PREFERRED EMBODIMENT(S)

The quaternary nitrogen atom can be incorporated, for example, in a quaternary ammonium or iminium group in an acyclic or cyclic structure or in a heterocyclic aromatic group. The tertiary amine function comprises another nitrogen atom with three substituents, two of which can also form a ring. The third substituent forms a bridge to the quaternary nitrogen atom. A molecule can also contain more than one quaternary nitrogen atom and tertiary amine function.

The onium compounds of the invention can comprise a cation of the generic formulas (I), (II), (III)

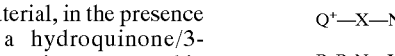

$$Q^+—X—NR_1R_2 \quad (I)$$

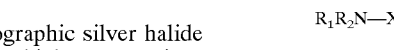

$$R_1R_2N—X—Q^+—Y—NR_3R_4 \quad (II)$$

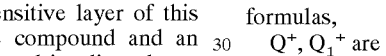

$$R_1R_2N—X—Q^+—A—Q_1^+—Y—NR_3R_4 \quad (III)$$

and the anions necessary to balance the charge. In these formulas, $Q^+$, $Q_1^+$ are the same or different, each being a quaternary ammonium or iminium group formed incorporating X and optionally Y and A or an optionally substituted N-imidazolium, N-thiazolium, or N-pyridinium group, X, Y, A are the same or different, each being an alkylene, hydroxyalkylene, alkyleneoxyalkylene, alkylenethioalkylene, alkyleneaminoalkylene, or hydroxyalkyleneoxyalkylene group, or a polyoxyalkylene chain, Y also being a single bond or an oxyalkylene, thioalkylene, or aminoalkylene group if it links to a carbon atom of an imidazolium, thiazolium, or pyridinium group, and $R_1$, $R_2$, $R_3$, $R_4$ are the same or different, each being an optionally substituted alkyl, alkoxy, alkylaryl, or phenyl group, with $R_1$ and $R_2$ as well as $R_3$ and $R_4$ also being capable of forming a ring.

The imidazolium, thiazolium, or pyridinium groups an be condensed with other aliphatic or aromatic ring systems, for example, to quinolinium, benzimidazolium, or benzthiazolium groups. They can also have other substituents, for example, alkyl groups, or functional groups, such as hydroxyl, mercapto, ester, and acid amide groups. In the case of the N-imidazolium group, such an additional substituent, preferably alkyl or substituted alkyl, is required on the other nitrogen atom to stabilize the quaternary structure, and the positive charge is not localized on one of the nitrogen atoms.

The groups X, Y, and/or A are preferably represented by chains in which the total number of carbon atoms and/or oxygen atoms plus nitrogen atoms plus sulfur atoms is 2 to 16, and Y in the above-cited special case can also be a single bond.

The alkyl groups in the $R_1$, $R_2$, $R_3$, $R_4$ radicals have preferably 1 to 4 carbon atoms in a straight or branched chain. These can also form rings pairwise, insofar as this is spatially possible, for example, $R_1$ with $R_2$ and $R_3$ with $R_4$. When $Q^+$ or $Q_1^+$ are quaternary ammonium or iminium groups, $R_1$ or $R_3$ can also form a ring with a radical on the nitrogen.

Examples of quaternary ammonium groups are $$—N^+R_5R_6R_7 \quad \text{(I-A)}$$

wherein $R_5$, $R_6$, and $R_7$ are alkyl, alkenyl, or alkinyl with 1 to 10 carbon atoms, $R_5$ is such a group with 1 to 20 carbon atoms or aralkyl, and $R_6$ and $R_7$ can also form a ring with 4 to 8 carbon atoms, and $$—N^+R_8R_9—A—N^+R_{10}R_{11}— \quad \text{(III-A)}$$

wherein $R_8$ and $R_{10}$ are the same as $R_5$, $R_9$ and $R_{11}$ are the same as $R_6$, A is the same as for Formula (III), and $R_8$ with $R_{10}$ as well as $R_9$ with $R_{11}$ can be linked in each case to a chain with 2 to 10 carbon atoms. An example of a cyclic, cationic group according to Formula (III) or (III-A) is the doubly quaternized 1,1-diazabicyclo(2.2.2)-octane.

An example of a quaternary iminium group is $$—N^+R_{12}=CR_{13}—R_{14} \quad \text{(I-B)}$$

or $$—N^+R_{12}=CR_{13}—NR_1R_2 \quad \text{(II-B)}$$

wherein $R_{12}$, $R_{13}$, and $R_{14}$ are the same as $R_5$, $R_1$ and $R_2$ are the same as in Formula (II), and two each of these groups can form a ring with 4 to 8 carbon or nitrogen atoms.

The anions can be the organic or inorganic anions usually employed for making organic salts in the number required for a balanced charge, for example, chloride, bromide, sulfate, nitrate, perchlorate, acetate, trifluoroacetate, and o-tosylate ions.

Examples of suitable onium compounds of the invention according to Formulas (I), (II), and (III) are:

(I-1)

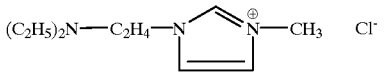

(I-2)

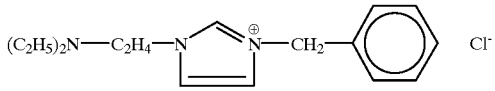

(I-3)

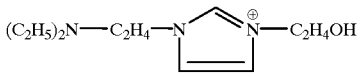

(I-4)

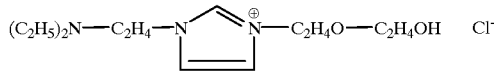

(I-5)

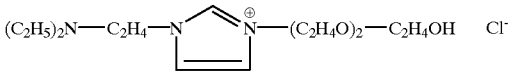

(I-6)

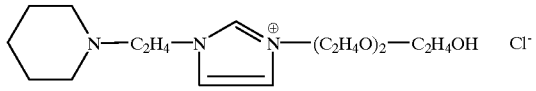

(I-7)

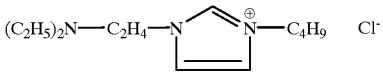

(I-8)

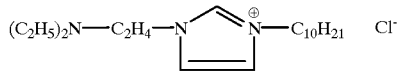

(I-9)

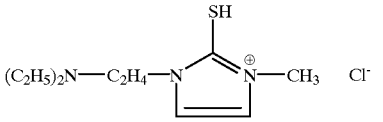

(I-10)

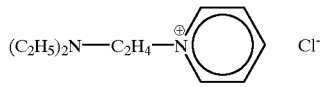

(I-11)

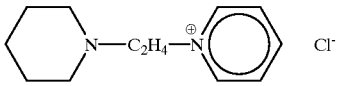

(I-12)

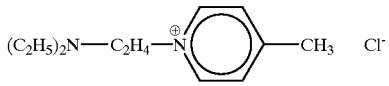

(I-13)

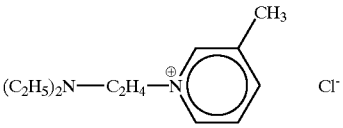

(I-14)

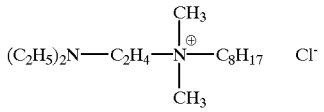

(I-15)

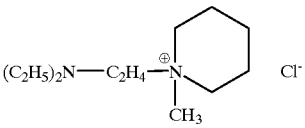

(I-16)

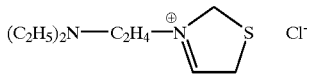

-continued
(I-17)
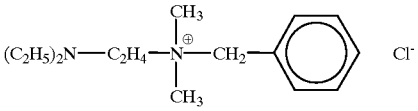
(I-18)
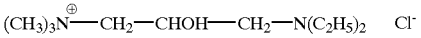
(I-19)
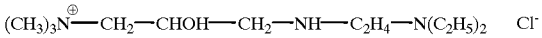
(I-20)
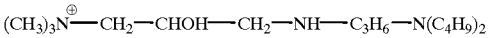
(I-21)
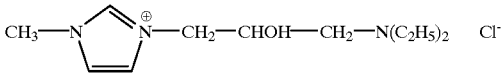
(I-22)
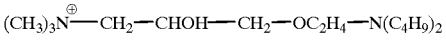
(I-23)
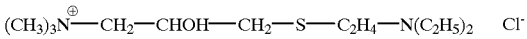
(I-24)
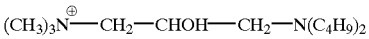
(I-25)
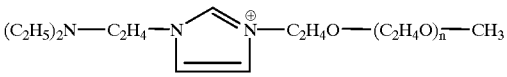
n = 11
(I-26)
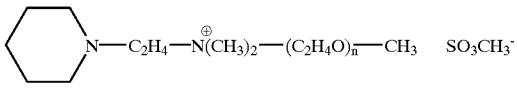
n = 12
(I-27)
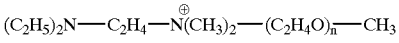
n = 17
(II-1)
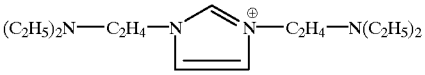
(II-2)
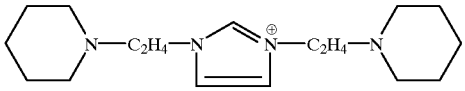
(II-3)
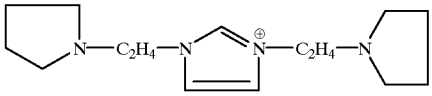
(II-4)
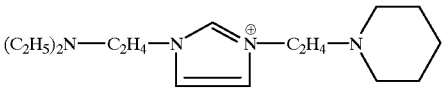
(II-5)
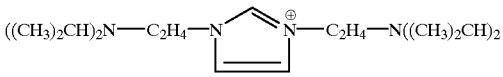
(II-6)
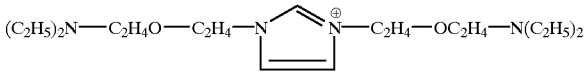
(where o-Tosylat⁻ is
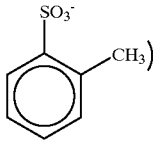
)
(II-7)
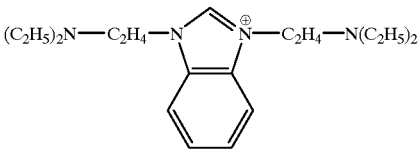
(II-8)
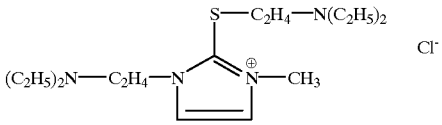
(II-9)
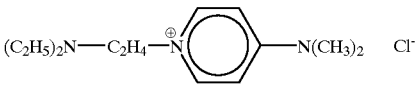
(II-10)
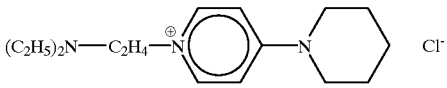

-continued (II-11)

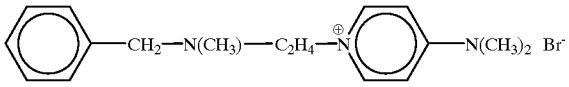

(II-12)

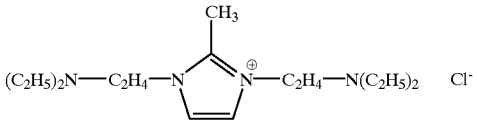

(II-13)

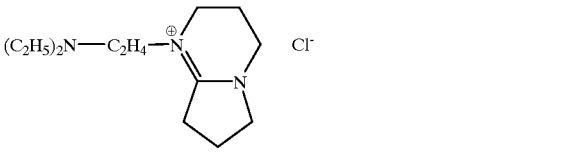

(II-14)

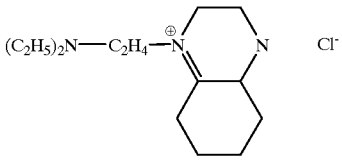

(III-1)

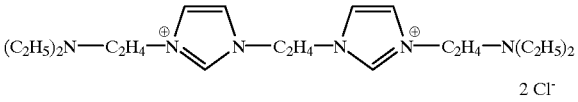

(III-2)

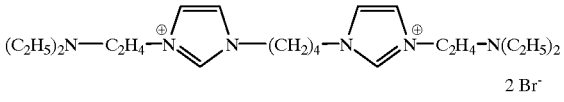

(III-3)

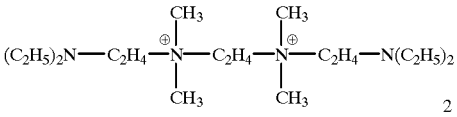

(III-4)

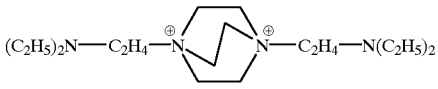

(III-5)

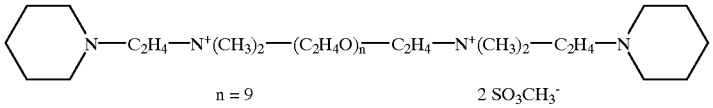

(III-6)

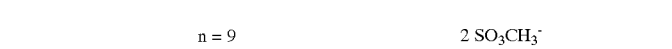

The X or Y bridge links the tertiary amine nitrogen with the quaternary nitrogen of the $Q^+$ group. Such compounds can be prepared quite simply from easily available starting materials. For example, the corresponding tertiary amines are reacted with ω-halogenated alkyl amines in the presence of alkalis, or glycidyl trimethylammonium chloride is reacted with secondary amines, dialkylaminoalkyl amines, diamino alcohols, or diamino mercaptans. An expert knows of other suitable methods (see, for example, Houben-Weyl, "Methods of Organic Chemistry", Volume XI/2, pages 591 ff., Stuttgart 1958).

The invention's compounds do not have to be isolated to be used in preparing developers or recording materials, if, as in the following examples, practically no side reactions occur and the presence of the only byproduct, alkali halide, can be tolerated. Therefore, the invention's process is especially simple and economical.

SYNTHESIS EXAMPLE 1

Preparation of 1,2-bis(2-diethylamino-ethyl) imidazolium chloride (Compound II-1)

17.2 g (0.1 mole) of 2-chloroethyl-diethylamino hydrochloride, 3.4 g (0.05 mole) of imidazole, and 30 ml of water are placed in a 100 ml Erlenmeyer flask. 6 g (0.15 mole) of sodium hydroxide are added at room temperature with stirring. A second phase is formed as spontaneous heating occurs. Further stirring for 2 hours yields a homogeneous, colorless solution, which is made up to 75.6 g with water. A 20% solution of Compound II-1 is thus obtained.

SYNTHESIS EXAMPLE 2

Preparation of 1-(2-diethylaminoethyl)-3-(polyethylenglycol methylether-1-yl)-imidazolium chloride (Compound I-25)

55 g (0.1 mole) of polyethylenglycol (molecular weight number average: 550) monomethyl ether are dissolved in 250 ml tetrahydrofurane and 11.2 g (0.11 mole) of triethylamine are added. The mixture is cooled with ice and 12.6 g (0.11 mole) of methanesulfonyl chloride are added dropwise under a nitrogen atmosphere while stirring. Thus, the methanesulfonate of polyethylenglycol methyl ether is formed. Stirring is continued for 24 hours at room temperature followed by refluxing for 3 hours. After cooling the precipitated triethylammonium chloride is filtered off and the solvent together with the excess amine is evaporated under vacuum on a steam bath. The residue is dissolved in 100 ml isopropanol, 9 g sodium salt of imidazole are added and the mixture is stirred at 50° C. for 6 hours. 17.2 g 2-diethylaminoethyl chloride and a solution of 4 g sodium hydroxide in 20 ml of water are added and stirring is continued for 3 hours. The reacted mixture is evaporated under vacuum. The oily residue is extracted with 50 ml tetrahydrofurane and afterwards dissolved in 290 ml of ethanol. The salt precipitate is filtered off and a 20 percent solution of the product is obtained which is used without further purification.

The synthesis of compounds according to the invention with polyoxyalkylene chains and having a quaternary ammonium or a pyridinium group as $Q^+$ can be carried out, e.g., by reaction of the corresponding mono-or bifunctional polyoxyalkylene methanesulfonate with a tertiary amino or a pyridin compound.

Particularly preferred onium compounds of the generic Formula (I) are those in which $Q^+$ as pyridinium or N'-alkyl-N- imidazolium and X as alkylene are not in the same molecule.

Especially preferred are compounds of Formula (I), (II), and (III) in which the X, Y, and/or A groups are alkyleneoxyalkylene or hydroxyalkylene groups in which the total number of carbon atoms and/or oxygen atoms plus nitrogen atoms plus sulfur atoms is 2 to 16. Incorporating such groups in the molecule offers, in addition to the selection of the Q group and the $R_1$, $R_2$, $R_3$, $R_4$ substituents, an additional possibility of selecting a compound with the optimum balance between higher solubility and greater contrast-producing action by appropriately selecting the number of hydroxyl or ether oxygen atoms, depending on the other desired process parameters, for example, concentration and pH of the developer solution, type of developer and hydrazine compound, development temperature and time. An expert can use known art from the surfactant field for this purpose.

In another preferred embodiment, the bridges X, Y, and/or A consist of polyoxyalkylene chains with 3 to 20 oxyalkylene units each having 2 to 4 carbon atoms. The number n of the oxyalkylene units is understood to be the number average value. Particularly preferred are polyoxyethylene chains. Such compounds are particularly suited for incorporation into emulsion or auxiliary layers, since they are hindered from diffusing and are compatible with anionic coating aids.

The recording material is developed in the invention's process preferably in the presence of a hydrazine compound. This hydrazine compound can be incorporated in the known manner either in one or more layers of the recording material or in the developer solution. Examples of suitable compounds and use methods are described in Research Disclosure 235 010 (November 1983), DE-27 25 743-A1, EP-00 32 456-B, EP-01 26 000-A2, EP-01 38 200-A2, EP-02 03 521-A2, EP-02 17 310-A2, EP-02 53 665-A2, EP-03 24 391-A2, EP-03 24 426-A2, EP-03 26 443-A2, EP-03 56 898-A2, EP-04 73 342-A1, and EP-05 01 546-A1.

Examples of suitable hydrazine compounds are (H-1)

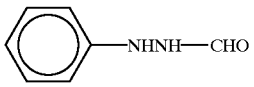

(H-2)

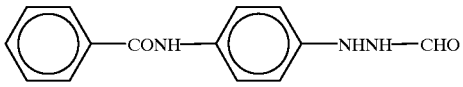

(H-3)

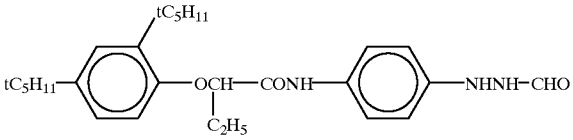

-continued (H-4)

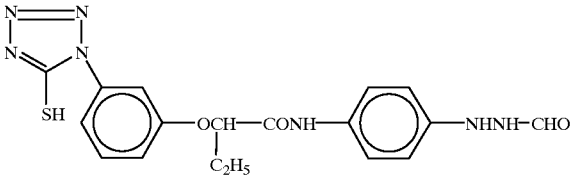

(H-5)

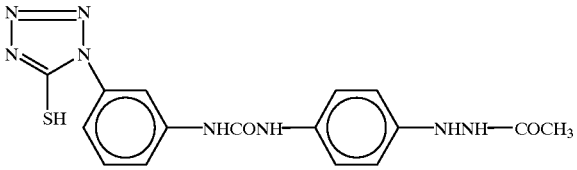

(H-6)

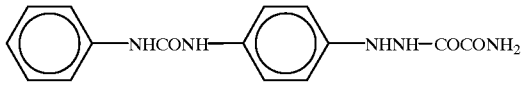

(H-7)

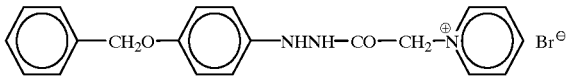

(H-8)

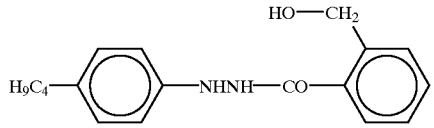

The preferred developer solutions used in the invention contain a dihydroxybenzene developer, for example, hydroquinone, pyrocatechol, methyl hydroquinone, or chlorohydroquinone, and an antioxidant, preferably an alkali sulfate in a concentration above 0.3 mole per liter. Especially preferred solutions have a pH of 9 to 11 maximum. Such developer solutions are stable in use and yield largely fog-free images.

Preferred developer solutions contain known superadditive auxiliary developers, for example, N-methyl-p-aminophenol or 1-phenylpyrazolidinone-3 or derivatives of these compounds.

Similarly preferred developers contain stabilizers of the benzotriazole and mercaptotetrazole groups. Examples of such stabilizers are 1-phenyl-5-mercaptotetrazole, 1-(1-naphthyl)-5-mercaptotetrazole, 1-cyclohexyl-5-mercaptotetrazole, 1-(4-chlorophenyl)-5-mercaptotetrazole, 1-(3-capramidophenyl)-5-mercaptotetrazole, benzotriazole, 5-chlorobenzotriazole, 5-bromobenzotriazole, 5-nitrobenzotriazole, 5-benzoylaminobenzotriazole, 1-hydroxymethylbenzotriazole, and 6-cyanobenzotriazole.

The photosensitive silver halides in the invention's recording materials are silver chloride, silver bromide, silver chlorobromide, silver bromoiodide, or silver chlorobromoiodide. They can be monodisperse or polydisperse, they can have a uniform composition or be core-shell grains, and they can also be mixtures of different size grains and different grain size distribution. They are prepared with the use of a hydrophilic colloidal binder, preferably gelatin. The silver halide grains can be spherical, polyhedral, or tabular. Methods for making suitable photosensitive silver halide emulsions are known to one skilled in the art and are summarized, for example, in Research Disclosure 178 043, Sections I and II.

The preferred silver halide emulsions used for the invention's recording materials are made by controlled double jet precipitation, have cubic grains, and contain a chloride proportion of less than 50 mole percent.

The size of the silver halide grains in the emulsions depends on the required sensitivity. For example, the cubic grains can be 0.1 to 0.7 μm in edge length, the preferred range being between 0.15 and 0.30 μm. Noble metal salts, especially rhodium or iridium salts, can be present in the usual quantities during emulsion preparation to improve photographic properties.

The preferred emulsions are sensitized chemically. Suitable methods are by sulfur, reduction, or noble metal sensitization, which can also be used in combinations. Gold or iridium compounds are examples of noble metal sensitizers.

The emulsions can be sensitized spectrally with the usual sensitizing dyes.

The emulsions can also contain the usual antifoggants. Optionally substituted benzotriazole, 5-nitroindazole, and mercury chloride are preferred. These agents can be added anytime during emulsion preparation or can be added in an auxiliary coating of the photographic material. Approximately 1 mmole of an iodide per mole of silver can be added to the emulsion before or after chemical ripening to improve photographic properties.

The emulsions can also contain known polymer dispersions to improve, for example, the dimensional stability of the photographic material. These generally involve latexes of hydrophobic polymers in an aqueous matrix. Examples of suitable polymer dispersions known to those skilled in the art are cited in Research Disclosure 176 043, Section IX B (December 1978).

The photosensitive layers of the photographic materials can be hardened with a known agent. This hardening agent can be added to the emulsion or to an auxiliary layer, for example, an outer protective coating. A preferred hardening agent is hydroxydichlorotriazine.

The photographic material can contain other additives that are standard and known to produce specific properties. Such additives are summarized, for example, in Research Disclosure 176 043 in Sections V (Optical Brighteners), XI (Coating Aids), XII (Plasticizers and Slip Agents), and XVI (Matte Agents).

The gelatin content of the emulsions is generally between 50 and 200 g per mole of silver, the range between 70 and 150 g per mole of silver being preferred.

In the invention's process, the current state-of-the-art use of alkanolamines is either completely omitted or the quantity can be reduced to a small fraction. Therefore, the process can operate without troublesome or injurious odor and corrosion by amino compounds volatilizing from the developer.

The invention's process can also produce ultrahigh contrast if the onium compounds are only in the recording material. In comparison, state-of-the-art amino compounds that increase contrast, especially the alkanolamines, must be added to the developer.

The required concentration of the compounds used in the invention is substantially lower than the currently conventional concentrations of alkanolamines. In addition, the compounds are not volatile and have good water solubility. Therefore, they give good results in terms of economy, personnel health protection, and disposal.

The invention can be used to make negative images with ultrahigh contrast, especially for reprography in the steps preliminary to black/white and color printing.

The following known development accelerators and contrast-augmenting agents were used as comparison materials in the examples:

V1 1-phenethylpicolinium bromide

V2 1-dodecylpyridinium bromide

V3 1-decyl-3-methylimidazolium bromide

V4 Tetrabutylammonium hydroxide

V5 1-(2-dimethylaminoethyl)imidazole

V6 2-diethylaminoethanol

V7 Diethylaminopropanediol

The invention's compounds were always used as aqueous solutions of 20 to 50 g per 100 ml. However, the quantity data are for the pure material in each case.

EXAMPLE 1

A cubic silver bromide emulsion with grains having an edge length of 0.23 μm was prepared by pAg-controlled double jet precipitation. After the soluble salts were removed by the flocculation method, the total gelatin content was adjusted to 80 g per mole of silver and the emulsion was ripened chemically with gold salt and thiosulfate. An optical sensitizer for the green range, the usual stabilizers, coating aids, and 0.17 g of 1-pyridiniumacetyl-2-(4-benzyloxyphenyl)hydrazine bromide (Compound H-7) per mole of silver were added. The emulsion was coated on a polyethylene terephthalate base with a gelatin protective coating. The coating weight of these layers was 4.5 g of silver and 0.9 g of gelatin per square meter, respectively.

Samples of the resulting recording material were exposed through a sensitometric wedge transparency with a graduated density sequence and a combination of such a sensitometric wedge with a contact halftone screen. The samples were processed in a roll development machine with the developer described below at 36° C. for 28 s development time and a commercial fixing bath.

The following data were measured on the processed samples:

(a) Maximum density, $D_{max}$, (b) Sensitivity, S, as the reciprocal of the exposure required for the 50% halftone value, relative to Sample 1 as the comparison, and (c) Gradation, G, as the average slope of the density curve recorded with the graduated density wedge between the optical densities 2.0 and 4.0.

The developer formulation was:

| | |
|---|---|
| Water | 500 g |
| Sodium bisulfite | 42 g |
| Trisodium salt of ethylene diamine tetraacetic acid | 3.7 g |
| Hydroquinone | 25 g |
| N-methyl-p-aminophenol hemisulfate | 2.75 g |
| Potassium bromide | 1 g |
| Benzotriazole | 0.5 g |
| 1-phenyl-2-mercaptotetrazole | 0.04 g |
| Mercaptobenzothiazole | 0.04 g |
| Potassium hydroxide (50% solution) | 47 ml |

-continued

| The developer formulation was: | |
|---|---|
| Potassium carbonate (50% solution) | 28.5 ml |
| Additives as shown in Table 1 in g | |
| Water to make 1 liter (l), | |
| pH adjusted to 10.9 at 25° C. | |

The test results are summarized in Table 1. It shows that the presence of the known development accelerators V1 and V2 does not yield satisfactory density and gradation values. The amino compound V6 in larger quantities does yield adequately high contrast, but it involves an annoying and unwholesome odor. A comparison of Tests 4 and 5 with 8 and 9 shows that the linkage of the quaternary nitrogen and amino function in one molecule is actually essential for the invention's effect.

TABLE 1

| Test | Additive Compound, Quantity | $D_{min}$ | $D_{max}$ | S | G | Remarks, Developer |
|---|---|---|---|---|---|---|
| 1 | — | 0.04 | 4.0 | 1.00 | 4.0 | Comparison |
| 2 | V1, 0.13 g | 0.04 | 4.4 | 1.22 | 4.5 | Comparison |
| 3 | V2, 1.0 g | 0.04 | 4.2 | 1.03 | 4.0 | Comparison, turbid |
| 4 | V1, 0.13 g<br>V5, 1.0 g | 0.04 | 4.7 | 1.28 | 4.4 | Comparison |
| 5 | V1, 0.13 g<br>V5, 5.0 g | 0.04 | 5.0 | 1.31 | 4.7 | Comparison, precipitate forms |
| 6 | V1, 0.13 g<br>V6, 10 g | 0.04 | 5.1 | 1.43 | 8.7 | Comparison, amine odor |
| 7 | V1, 0.13 g<br>V6, 25 g | 0.04 | 5.6 | 1.62 | >25 | Comparison, strong amine odor |
| 8 | V1, 0.13 g<br>II-1, 0.5 g | 0.04 | 5.2 | 1.34 | 12 | Invention, clear and odor-free |
| 9 | V1, 0.13 g<br>II-1, 1.2 g | 0.04 | 5.5 | 1.38 | 18 | Invention, clear and odor-free |

EXAMPLE 2

Samples of the recording materials used in Example 1 were exposed, developed, and evaluated as described there, using developer of the following composition:

| | |
|---|---|
| Water | 500 g |
| Potassium hydroxide (50% solution) | 60 g |
| Potassium bisulfite | 66 g |
| Ethylenediamine tetraacetic acid | 3.0 g |
| Sodium carbonate monohydrate | 48 g |
| Potassium bromide | 3 g |
| Benzotriazole | 0.5 g |
| 1-phenyl-2-mercaptotetrazole | 0.05 g |
| Hydroquinone | 25 g |
| N-methyl-p-aminophenol hemisulfate | 1.5 g |
| Potassium carbonate (50% solution) | 28.5 ml |
| Additives as shown in Table 2 in g | |
| Water to make 1 l, | |
| pH at 25° C. adjusted as shown in Table 2. | |

The results are summarized in Table 2.

TABLE 2

| Test | Additive Compound, Quantity | pH | $D_{min}$ | $D_{max}$ | S | G | Remarks |
|---|---|---|---|---|---|---|---|
| 10 | — | 10.9 | 0.04 | 4.4 | 1.00 | 4 | Comparison |
| 11 | V7, 25 ml | 10.9 | 0.04 | 5.0 | 1.32 | 7.7 | Comparison |
| 12 | V7, 25 ml | 10.6 | 0.04 | 4.7 | 1.09 | 5.7 | Comparison |
| 13 | V1, 0.2 g | 10.9 | 0.04 | 5.1 | 1.16 | 7 | Comparison |
| 14 | V1, 0.2 g<br>I-5, 0.8 g | 10.9 | 0.04 | 5.6 | 1.27 | 20 | Invention |
| 15 | V1, 0.2 g<br>I-5, 0.8 g | 10.6 | 0.04 | 5.4 | 1.24 | 14 | Invention |
| 16 | I-5, 0.8 g | 10.9 | 0.04 | 5.6 | 1.23 | 20 | Invention |
| 17 | II-1, 1.2 g | 10.9 | 0.04 | 5.6 | 1.28 | 20 | Invention |

EXAMPLE 3

A cubic silver bromide emulsion with grains having an edge length of 0.20 $\mu$m was prepared by pAg-controlled double jet precipitation. After the soluble salts were removed by the flocculation method, the total gelatin content was adjusted to 80 g per mole of silver. The emulsion was ripened chemically with a gold salt and 0.3 mmole of thiosulfate per mole of silver. 5 mmoles of potassium iodide, an optical sensitizer for the green range, the usual stabilizers and coating aids, 1 mmole of 1-pyridiniumacetyl-2-(4-benzyloxyphenyl)-hydrazine bromide (Compound H-7) per mole of silver were added. The emulsion was coated with a gelatin protective coating on a polyethylene terephthalate support. The coating weight of these layers was 3.5 g of silver and 0.8 g of gelatin respectively per square meter. The gelatin protective coating also contained 0.4 g/m$^2$ of a dispersion of a styrene/acrylate copolymer, 2,4-di-chloro-6-hydroxytriazine as a hardening agent, and the additives (in g/m$^2$) listed in the following Table 3.

Samples of the resulting recording materials were exposed, processed, and evaluated as in Example 1, using the developers given for Test 13 or 14 of Example 2.

The results are shown in Table 3. The sensitivity, S, is relative to Test 18.

TABLE 3

| Test | Additive Compound, Quantity | Developer for Test | $D_{min}$ | $D_{max}$ | S | G |
|---|---|---|---|---|---|---|
| 18 | — | 13 | 0.04 | 4.7 | 1.00 | 5.5 |
| 19 | II-10, 0.015 g/m$^2$ | 13 | 0.04 | 4.7 | 1.04 | 22 |
| 20 | II-14, 0.060 g/m$^2$ | 13 | 0.04 | 4.7 | 1.03 | 18 |
| 21 | V5, 0.100 g/m$^2$ | 13 | 0.04 | 4.7 | 0.97 | 6 |
| 22 | V6, 0.100 g/m$^2$ | 13 | 0.04 | 4.7 | 1.00 | 5.4 |
| 23 | I-20, 0.020 g/m$^2$ | 13 | 0.04 | 4.7 | 1.05 | 25 |
| 24 | — | 14 | 0.04 | 4.7 | 1.03 | 15 |
| 25 | II-10, 0.015 g/m$^2$ | 14 | 0.04 | 4.8 | 1.03 | >25 |
| 26 | II-14, 0.060 g/m$^2$ | 14 | 0.04 | 4.8 | 1.03 | >25 |
| 27 | V5, 0.100 g/m$^2$ | 14 | 0.04 | 4.7 | 1.00 | 15 |
| 28 | V6, 0.100 g/m$^2$ | 14 | 0.04 | 4.6 | 1.03 | 15 |
| 29 | I-20, 0.020 g/m$^2$ | 14 | 0.04 | 4.7 | 1.05 | >25 |

These results show that an ultrahigh contrast can be achieved only when the invention's compounds are present at least in the recording material or in the developer.

EXAMPLE 4

Samples of a commercial daylight copy film [Film H: Type BLE from Du Pont de Nemours (Deutschland) GmbH]

and a phototypesetting film (Film P: Type CHI from the same company) were exposed through a graduated density wedge and processed in the developer for Tests 10 and 17 of Example 2 for 28 s at 36° C. The data measured on the processed samples were minimum and maximum density ($D_{min}$ and $D_{max}$), sensitivity (S) as the reciprocal of the exposure required for 3.5 density, in each case relative to the sample developed with the developer of Test 10, gradation (G1) between the densities 0.1 and 0.4, and gradation (G2) between the densities 0.4 and 3.5.

The results listed in Table 4 show that contrast is also increased by the use of the invention's Compound II-1 in processing without hydrazine compounds.

TABLE 4

| Test | Film | Developer for Test | $D_{min}$ | $D_{max}$ | S | G1 | G2 |
|---|---|---|---|---|---|---|---|
| 30 | H | 10 | 0.04 | 5.2 | 1.00 | 1.7 | 5.1 |
| 31 | H | 17 | 0.04 | 5.5 | 1.15 | 1.7 | 6.3 |
| 32 | P | 10 | 0.05 | 6.4 | 1.00 | 1.91 | 2.5 |
| 33 | P | 17 | 0.05 | 6.3 | 1.20 | 2.51 | 3.9 |

EXAMPLE 5

A cubic silver chlorobromide (80 mole percent chloride) emulsion with grains having an edge length of 0.23 $\mu$m was prepared by pAg-controlled double jet precipitation. After removing the soluble salts by the flocculation method, the total gelatin content was adjusted to 55 g per mole of silver and the emulsion was chemically ripened with gold salt and thiosulfate in the presence of potassium toluolthiosulfonate. After that, potassium iodide (1.6 mmole per mole of silver), benzotrizole and hydroxymethyltetraazaindene as organic stabilizers, a polyethylene dispersion, an optical sensitizer for the green range, usual coating aids, 0.1 mmol per mole silver of compound H-7, and 0.15 mmole per gram gelatin of dichlorohydroxytriazine were added. The emulsion was coated simultaneously with an abrasion layer solution on a polyethylene terephthalate carrier. The abrasion layer solution contained gelatin, matting agents, coating aids, and the additives shown in Table 5 in water. Coating weights of emulsion and abrasion solution corresponded to 4.2 g/m$^2$ silver and 0.9 g/m$^2$ gelatin, respectively. Samples of the resulting recording material were exposed and processed as described in Example 1. The developer formulation was:

| | |
|---|---|
| Water | 500 g |
| Sodium bisulfite | 50 g |
| Potassum hydroxide | 27 g |
| Trisodium salt of ethylene diamine tetraacetic acid | 3.7 g |
| Hydroquinone | 25 g |
| Potassium bromide | 4 g |
| Benzotriazole | 0.3 g |
| 1-Phenyl-2-mercaptotetrazole | 0.05 g |
| 4-Hydroxymethyl-4-methyl-1-phenylpyrazolidone | 1 g |
| Boric acid | 3 g |
| Sodium hydroxide | 24 g |
| Diethylene glycol | 40 g |
| Water | to make 1 liter |
| pH adjusted to 10.5 at 25° C. | |

The results given in Table 5 show that gradation is unexpectedly increased by the compounds according to the invention even with the rather high gradation of the gold-ripened high chloride starting emulsion and in absence of contrast promoting amino compounds and at low pH. On the other hand, the known development accelerators have only moderate effect on speed and gradation.

TABLE 5

| Test | Compound/Quantity (mg/m$^2$) | $D_{min}$ | $D_{max}$ | S | G |
|---|---|---|---|---|---|
| 34 | — | 0.04 | 6.0 | 1.00 | 9.2 |
| 35 | V1/40 | 0.04 | 6.0 | 1.09 | 13 |
| 36 | V2/40 | 0.04 | 6.2 | 1.05 | 12 |
| 37 | II-10/20 | 0.04 | 6.0 | 1.19 | >25 |
| 38 | I-25/40 | 0.04 | 6.2 | 1.13 | >25 |
| 39 | I-5/40 | 0.04 | 6.0 | 1.11 | >25 |

What is claimed is:

1. A process to make ultrahigh contrast photographic negative images by developing in the presence of an onium compound a photosensitive recording material having at least one layer with a silver halide emulsion, characterized in that the onium compound comprises a cation having generic formulas (I), (II), (III)

$$O^+—X—NR_1R_2 \quad (I)$$

$$R_1R_2N—X—O^+—Y—NR_3R_4 \quad (II)$$

$$R_1R_2N—X—O^+—A—O_1^+—NR_3R_4 \quad (III)$$

wherein $O^+$, $O_1^+$ are the same or different, selected from the group consisting of guaternary ammonium and iminium;

X, Y, A are the same or different, selected from the group consisting of alkylene, hydroxyalkylene, alkylene oxyalkylene, alkylenethioalkylene, alkyleneaminoalkylene, and hydroxyalkyleneoxyalkylene, and a polyoxyalkylene chain and wherein Y is also selected from the group consisting of a single bond, an oxyalkylene, thioalkylene, and amino alkylene group if it links to a carbon atom of an imidazolium, thiazolium, or pyridinium group;

$R_1R_2R_3R_4$ are the same or different, selected from the group consisting of an alkyl, alkoxy, alkylaryl, and phenyl, each of which may be unsubstituted or substituted, with $R_1$ and $R_2$ as well as $R_3$ and $R_4$ also being capable of forming a ring; and at least one anion required to balance the charge.

2. The process according to claim 1, characterized in that the recording material is developed in the presence of a hydrazine compound.

3. The process according to claim 1, characterized in that the groups X, Y, and/or A are represented by chains in which the total number of carbon atoms and/or oxygen atoms plus nitrogen atoms plus sulfur atoms is 2 to 16.

4. The process according to claim 1, characterized in that the X, Y, and/or A groups are alkyleneoxyalkylene or hydroxyalkylene groups with 2 to 12 carbon atoms plus oxygen atoms or polyoxyalkylene chains with 3 to 20 oxyalkylene units each having 2 to 4 carbon atoms.

5. The process according to claim 1, characterized in that a developer contains the onium compound.

6. The process according to claim 1, characterized in that the onium compound is contained in the at least one layer with the silver halide emulsion or in another layer that has a reactive interrelationship with the at least one layer with the silver halide emulsion.

7. The process according to claim 5, characterized in that the developer contains dihydroxybenzene and at least 0.3 mole/l of sulfite.

8. The process according to claim 7, characterized in that the developer has a pH between 9 and 11.

9. The process according to claim 7, characterized in that the developer contains stabilizers selected from the class of benzotriazoles and mercaptotetrazoles.

10. The process of claim 1, wherein the iminium is selected from the group consisting of N-imidazolium, N-thiazolium and N-pyridinium, each of which may be unsubstituted or substituted.

* * * * *

UNITED STATES PATENT AND TRADEMARK OFFICE

CERTIFICATE OF CORRECTION

PATENT NO. : 6,218,070 B1 
DATED : May 22, 2001
INVENTOR(S) : Marc Van Damme et al.

It is certified that error appears in the above-identified patent and that said Letters Patent is hereby corrected as shown below:

Column 16,
Line 30, "$R_1R_2N\text{-}X\text{-}O^+\text{-}A\text{-}O_1{}^+\text{-}NR_3R_4$" should read -- $R_1R_2N\text{-}X\text{-}O^+\text{-}A\text{-}O_1{}^+\text{-}Y\text{-}NR_3R_4$ --.

Signed and Sealed this

Ninth Day of July, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,218,070 B1
DATED : April 17, 2001
INVENTOR(S) : Reinhold Rüger

It is certified that error appears in the above-identified patent and that said Letters Patent is hereby corrected as shown below:

Column 16,
Line 30, "$R_1R_2N\text{-}X\text{-}O^+\text{-}A\text{-}O_1{}^+\text{-}NR_3R_4$" should read -- $R_1R_2N\text{-}X\text{-}O^+\text{-}A\text{-}O_1{}^+\text{-}Y\text{-}NR_3R_4$ --.

This certificate supersedes Certificate of Correction issued July 9, 2002

Signed and Sealed this

Eighth Day of October, 2002

*Attest:*

*Attesting Officer*

JAMES E. ROGAN
*Director of the United States Patent and Trademark Office*